US011840415B2

(12) United States Patent
Taniguchi

(10) Patent No.: US 11,840,415 B2
(45) Date of Patent: Dec. 12, 2023

(54) IMAGE FORMING APPARATUS

(71) Applicant: KYOCERA Document Solutions Inc., Osaka (JP)

(72) Inventor: Susumu Taniguchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 186 days.

(21) Appl. No.: 17/504,244

(22) Filed: Oct. 18, 2021

(65) Prior Publication Data

US 2022/0127091 A1 Apr. 28, 2022

(30) Foreign Application Priority Data

Oct. 26, 2020 (JP) ..... 2020-178616

(51) Int. Cl.

| | |
|---|---|
| ***B65H 3/06*** | (2006.01) |
| ***B65H 5/36*** | (2006.01) |
| ***G03G 15/00*** | (2006.01) |
| ***B65H 1/26*** | (2006.01) |
| ***B65H 5/06*** | (2006.01) |

(52) U.S. Cl.

CPC ..... *B65H 3/0684* (2013.01); *B65H 1/26* (2013.01); *B65H 5/062* (2013.01); *B65H 5/36* (2013.01); *G03G 15/6529* (2013.01); *B65H 2301/341* (2013.01); *B65H 2402/441* (2013.01)

(58) Field of Classification Search

CPC ..... B65H 2301/341; B65H 5/36; B65H 2402/441; B65H 5/062; B65H 3/0684; B65H 1/26; B65H 3/06; B65H 1/04; B65H 2404/7431; B65H 2402/44; B65H 2404/612; B65H 2404/6111; B65H 5/38; G03G 15/6529; G03G 21/1633

See application file for complete search history.

(56) References Cited

U.S. PATENT DOCUMENTS

2014/0203503 A1* 7/2014 Ishikura ..... B65H 5/062 271/273
2014/0353908 A1* 12/2014 Kobayashi ..... B65H 7/20 271/226
2015/0084272 A1* 3/2015 Maruyama ..... G03G 15/6529 271/226
2016/0368723 A1* 12/2016 Hayakawa ..... B65H 5/26
2021/0032055 A1* 2/2021 Uehara ..... G03G 15/6529

FOREIGN PATENT DOCUMENTS

JP 2003-137453 A 5/2003

* cited by examiner

*Primary Examiner* — Jennifer Bahls
(74) *Attorney, Agent, or Firm* — Stein IP LLC

(57) ABSTRACT

An image forming apparatus has an apparatus main body, a sheet conveyance passage, a cover member, a conveyance unit, a sheet tray, a first sheet feeding portion, and a feed unit. The sheet conveyance passage is inside the apparatus main body. The conveyance unit is inside the cover member and is supported to be pivotable between an open position and a closed position. The first sheet feeding portion has a feed unit. The conveyance unit has a swing guide of which a lower end part is swingably supported on the apparatus main body and which, in the closed position, is located in a first position to face the feed unit and constitute part of the sheet conveyance passage and, in the open position, is located in a second position to be located away from the feed unit.

5 Claims, 5 Drawing Sheets

IMAGE FORMING APPARATUS

INCORPORATION BY REFERENCE

This application is based on and claims the benefit of priority from Japanese Patent Application No. 2020-178616 filed on Oct. 26, 2020, the contents of which are hereby incorporated by reference.

BACKGROUND

The present invention relates to image forming apparatuses such as copiers, printers, and facsimile machines as well as multifunction peripherals having their functions integrated together.

A known image forming apparatus includes an apparatus main body, a sheet tray on which sheets are stacked, and a feed unit for feeding the sheets in the sheet tray downstream. The sheet tray in this image forming apparatus is provided so as to be mountable in and dismountable from the apparatus main body by being pulled out and put in in the horizontal direction. The feed unit is provided downstream of the sheet tray in its mounting direction (i.e., in the direction in which it is put into the apparatus main body). The feed unit includes a pair of conveying rollers which includes a feed roller and a retard roller. The feed unit feeds downstream the sheets stacked in the sheet tray.

SUMMARY

According to one aspect of the present disclosure, an image forming apparatus includes an apparatus main body, a sheet conveyance passage, a cover member, a conveyance unit, a sheet tray, and a first sheet feeding portion. The apparatus main body has an image forming portion inside it. The sheet conveyance passage is formed inside the apparatus main body and extends in the up-down direction along a side surface of the apparatus main body. The cover member supported so as to be rotatable about a lower end part of it with respect to the apparatus main body, and is openable and closable The conveyance unit is provided inside the cover member and is supported so as to be pivotable between an open position, where it leaves the sheet conveyance passage open, and a closed position, where it leaves the sheet conveyance passage closed. On the sheet tray, sheets are stacked. The first sheet feeding portion is provided in a lower part of the apparatus main body, and has the sheet tray dismountably mounted in it. The first sheet feeding portion has a feed unit that feeds the sheets stacked on the sheet tray. The conveyance unit has a swing guide. The swing guide has a lower end part of it swingably supported on the apparatus main body. When the conveyance unit is in the closed position, the swing guide is located in a first position where it faces the feed unit and constitutes part of the sheet conveyance passage; when the conveyance unit is in the open position, the swing guide is located in a second position where it is located away from the feed unit.

DETAILED DESCRIPTION

Figure 1:
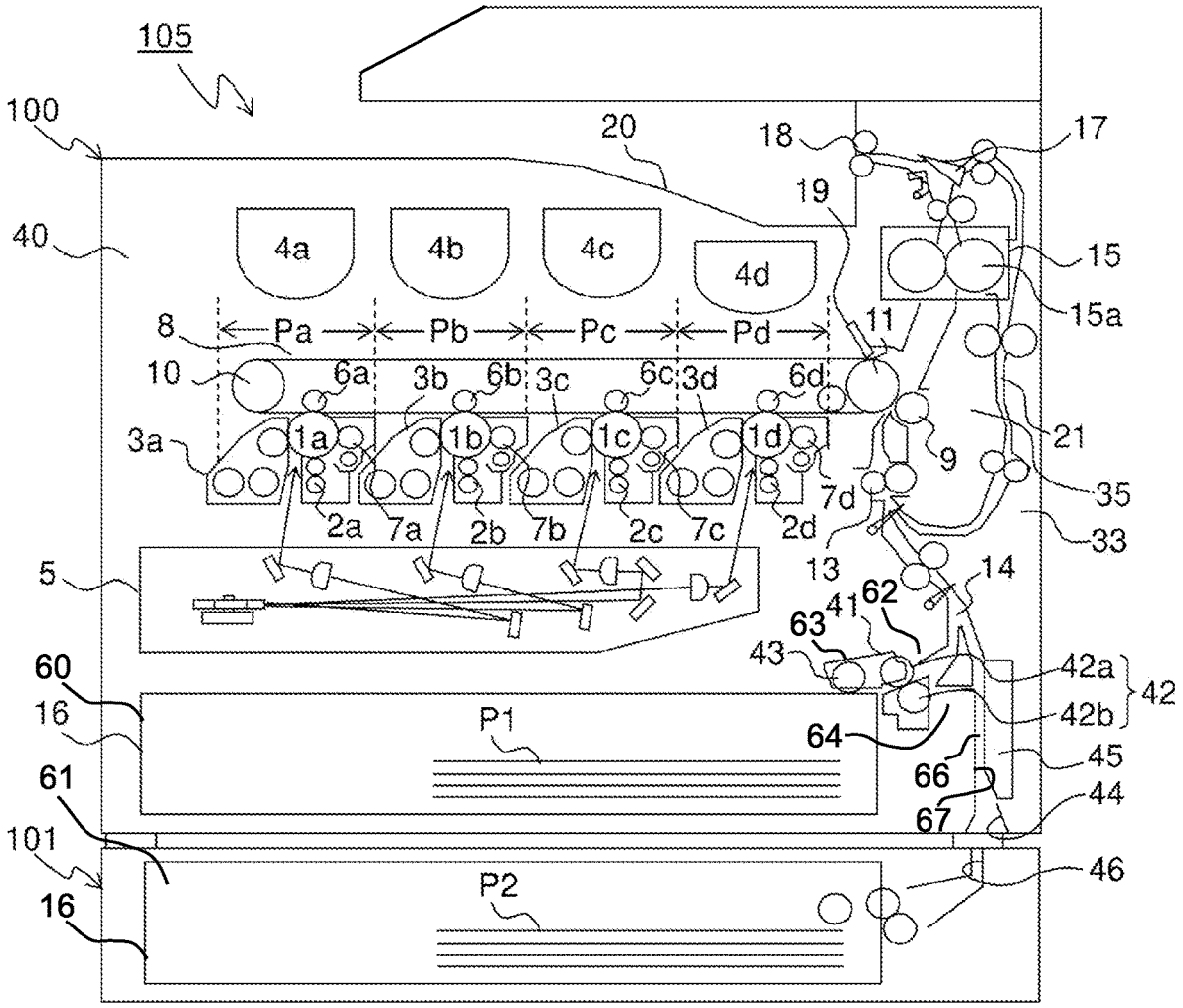
FIG. 1 is a sectional view showing an outline of the construction of an image forming apparatus 100 according to the present disclosure.

With reference to the accompanying drawings, an embodiment of the present disclosure will be described below. FIG. 1 is a sectional view showing an outline of the construction of an image forming apparatus 100 according to the present disclosure. From below the image forming apparatus 100, an optional unit 101 is connected to it to form an image formation unit 105. The image forming apparatus 100 according to the embodiment is a four-stage tandem-type color copier that has four photosensitive drums 1*a*, 1*b*, 1*c*, and 1*d* corresponding to four different colors (magenta, cyan, yellow, and black) disposed in a row.

In the apparatus main body 40 of the image forming apparatus 100, four image forming protons Pa, Pb, Pc, and Pd are disposed in this order from the left side in FIG. 1. These image forming portions Pa to Pd are provided to correspond to four different colors (magenta, cyan, yellow, and black), and respectively form a magenta, a cyan, a yellow, and a black image sequentially, each through the processes of electrostatic charging, exposure to light, image development, and image transfer.

In these image forming portions Pa to Pd are respectively disposed the above-mentioned photosensitive drums 1*a* to 1*d*, which carry visible images (toner images) of the different colors. An intermediate transfer belt 8 that moves around counter-clockwise in FIG. 1 is provided adjacent to the image forming portions Pa to Pd. The toner images formed on these photosensitive drums 1*a* to 1*d* are sequentially transferred to the intermediate transfer belt 8 which moves while in contact with the photosensitive drums 1*a* to 1*d*, and are then, at a secondary transfer roller 9, transferred at once to a sheet P1 or P2. The toner images are fixed by a fixing device 15 to the sheet P1 or P2, which is then discharged out of the image forming apparatus 100. While the photosensitive drums 1*a* to 1*d* are rotated clockwise in FIG. 1, an image formation process is performed with respect to each of the photosensitive drums 1*a* to 1*d*.

In a lower part of the apparatus main body 40, a first sheet feeding portion 60 and a second sheet feeding portion 61 are provided. The second sheet feeding portion 61 is located under the first sheet feeding portion 60. The first sheet feeding portion 60 is formed in the apparatus main body 40. The second sheet feeding portion 61 is formed in the optional unit 101, which will be described later. In the first sheet feeding portion 60, a sheet cassette 16 (sheet tray) is housed which stores sheets P1. The first sheet feeding portion 60 has an opening (not shown) formed in a side surface of the apparatus main body 40 at one side in the horizontal direction (here, the left side surface in FIG. 1). Through the opening, the sheet cassette 16 can be pulled out and put in, that is, mounted and dismounted, in the horizontal direction with respect to the apparatus main body 40. In the following description, the direction, along the horizontal direction, along which the sheet cassette 16 is pulled out and put in will be referred to as the mounting direction.

The image forming apparatus 100 has an introduction port 44 formed that is open in the bottom surface of the image forming apparatus 100 (the surface located in a lowermost part of the apparatus main body 40 and facing down). To the introduction port 44 is connected a sheet conveyance passage 14 so as to extend upward from the opening rim of the introduction port 44. On the way along the sheet conveyance passage 14 are arranged, from bottom up, a pair of registration rollers 13, the secondary transfer roller 9, and the fixing device 1, the latter two mentioned above. The sheet conveyance passage 14 divides into two branches in a branch portion 17 (sheet reversing portion) located downstream of the fixing device 15. One branch of the sheet conveyance passage 14 leads to outside the apparatus main body 40 via a pair of discharge rollers 18. The other branch of the sheet conveyance passage 14 is connected to the reversal conveyance passage 21. The reversal conveyance passage 21 extends downward from the branch portion 17 and meets the sheet conveyance passage 14 at a position upstream of the secondary transfer roller 9.

Under the image forming apparatus 100, the optional unit 101 that can store sheets P2 in it is mounted. The optional unit 101 includes the second sheet feeding portion 61 mentioned above. The second sheet feeding portion 61 has an opening (not shown) formed in a side surface of the optional unit 101 at one side in the horizontal direction (here, the left side surface in FIG. 1). As in the first sheet feeding portion 60, in the second sheet feeding portion 61, a sheet cassette 16 (sheet tray) is housed which stores sheets P1. Through the opening (not shown), the sheet cassette 16 can be pulled out and put in in the mounting direction with respect to the optional unit 101.

The optional unit 101 has a discharge port 46 through which sheets P2 housed in it are discharged. With the optional unit 101 mounted under the image forming apparatus 100, the introduction port 44 of the sheet conveyance passage 14 is adjacent to the discharge port 46 in the sheet conveyance direction (here, the up-down direction). Through the introduction port 44, sheets discharged from the discharge port 46 are introduced.

Downstream of the first sheet feeding portion 60 in the mounting direction (at the far side in the direction in which the sheet cassette 16 is put in with respect to the apparatus main body 40), an upper feed guide 62 is formed which forms part of the wall surface of the sheet conveyance passage 14. The upper feed guide 62 extends from the inner space of the first sheet feeding portion 60 downstream in the sheet conveyance direction. On the upper feed guide 62, a feed unit 41 is provided. The sheet cassette 16 mounted in the first sheet feeding portion 60 is connected via the feed unit 41 to the sheet conveyance passage 14. The feed unit 41 feeds the sheets P1 stored in the sheet cassette 16 one by one to the sheet conveyance passage 14.

The feed unit 41 includes a pickup roller 43 and a pair of conveying rollers 42. The pickup roller 43 is provided so as to face the sheets P1 in the sheet cassette 16 in the up-down direction, and makes contact with the top surface of the bundle of sheets P1 in the sheet cassette 16. By rotating clockwise in FIG. 1, the pickup roller 43 conveys the topmost sheet P1 in the bundle of sheets P1 downstream.

The pair of conveying rollers 42 is provided downstream of the pickup roller 43. The pair of conveying rollers 42 is a pair of rotary rollers composed of a feed roller 42*a* and a retard roller 42*b*. The pair of conveying rollers 42 feeds the sheets P1 conveyed by the pickup roller 43 one by one to the sheet conveyance passage 14. Thus, even if a plurality of sheets P1 are fed simultaneously by the pickup roller 43, the pair of conveying rollers 42 separates them so that only the topmost one sheet in the sheet cassette 16 will be conveyed.

Figure 2:
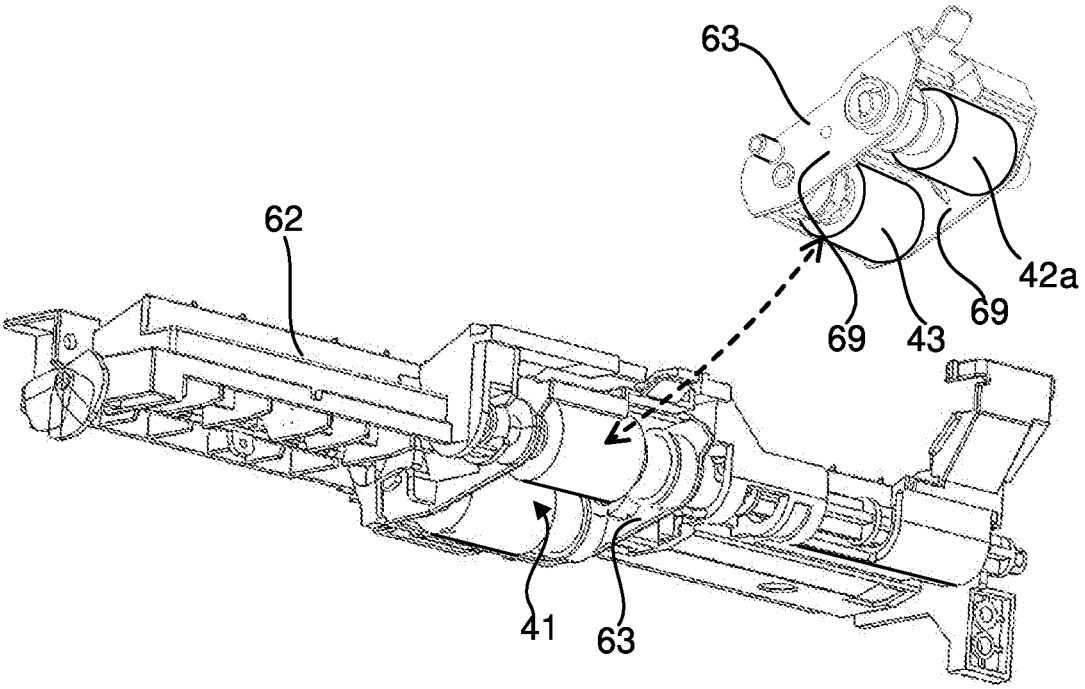
FIG. 2 is a perspective view showing an upper feed guide 62.
Figure 3:
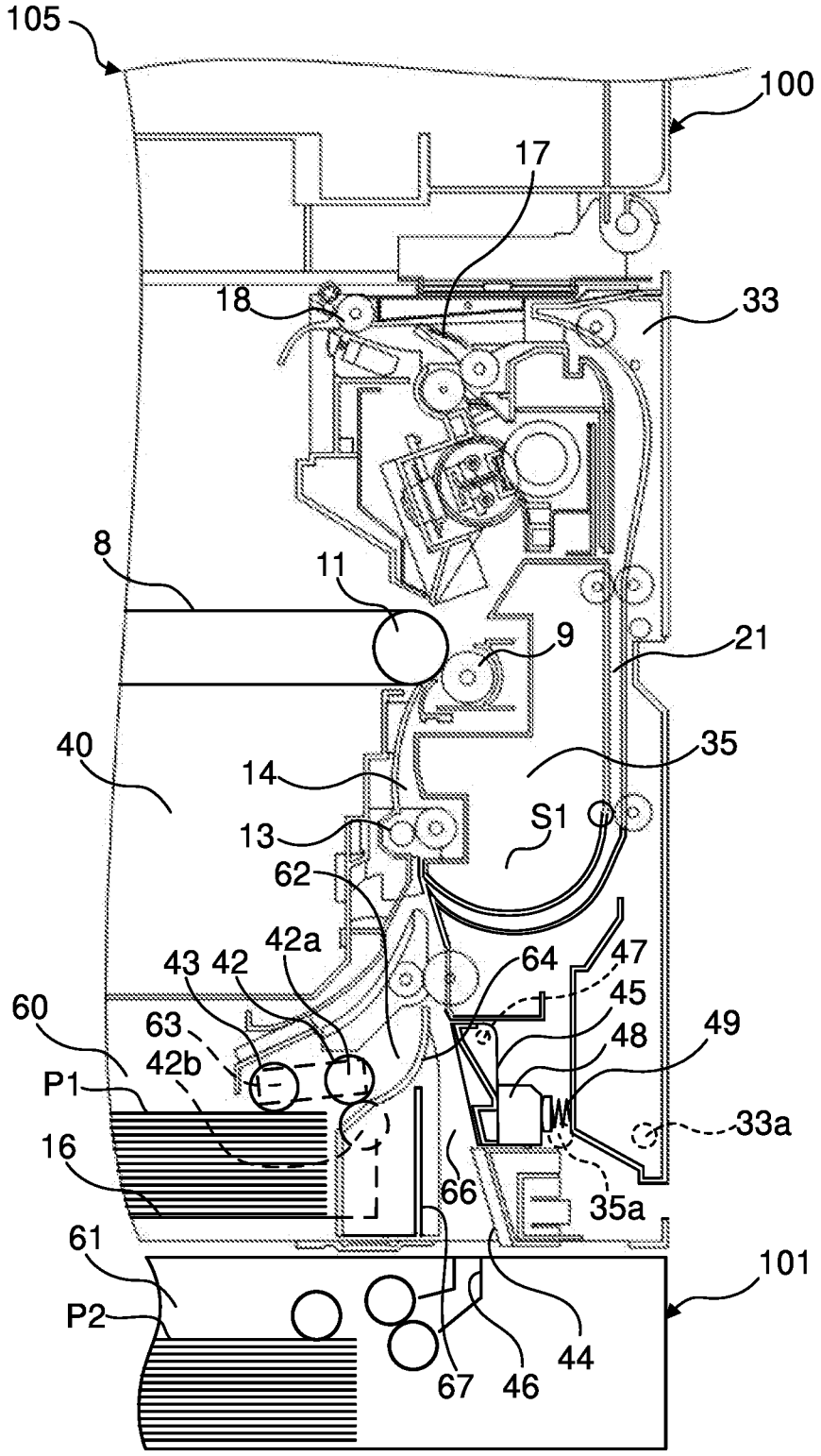
FIG. 3 is a sectional view around a sheet conveyance passage 14 and a reversal conveyance passage 21 in the image forming apparatus 100 in FIG. 1.

FIG. 2 is a perspective view showing the upper feed guide 62. FIG. 3 is a sectional view around the sheet conveyance passage 14 and the reversal conveyance passage 21 in the image forming apparatus 100. As shown in FIGS. 1, 2, and 3, on the upper feed guide 62, a feed holder 63 is mounted and supported. The feed holder 63 has a pair of side wall portions 69 opposite from each other in the sheet width direction (the near-far direction with respect to plane of FIGS. 1 and 3). The center shafts of the feed roller 42*a* and the pickup roller 43 are supported on the pair of side wall portions 69 so as to bridge between these. That is, the feed roller 42*a* and the pickup roller 43 are rotatably supported on the feed holder 63. The feed holder 63 is mountable and dismountable with respect to the upper feed guide 62 at the sheet conveyance passage 14 side (where a cover member 33 is provided as will be described later) of the upper feed guide 62 (see FIG. 1).

With the sheet cassette 16 mounted in the first sheet feeding portion 60 and the feed holder 63 mounted on the upper conveyance guide, the feed roller 42*a* faces the retard roller 42*b*, and these constitute the pair of conveying rollers 42.

In an end part of the first sheet feeding portion 60 at the sheet conveyance passage 14 side in the mounting direction (in a farthest part in the mounting direction), a lower feed guide 64 is provided. The lower feed guide 64 faces the upper feed guide 62 in the up-down direction, and extends from the inner space of the first sheet feeding portion 60 downstream in the sheet conveyance direction.

As shown in FIGS. 1 and 3, in an end part of the lower feed guide 64 at the sheet conveyance passage 14 side in the mounting direction, an opposite face 67 is formed which rises upward from a bottom part of the sheet cassette 16. The opposite face 67 faces, with the sheet conveyance passage 14 in between, a swing guide 45, which will be described later.

Downstream of the pair of conveying rollers 42, the pair of registration rollers 13 is provided. A sheet P1 fed into the sheet conveyance passage 14 by the feed unit 41 has a skew in it corrected, and has its feed timing coordinated with image formation, by the pair of registration rollers 13, and is then conveyed to the secondary transfer roller 9. Also a sheet P2 introduced through the introduction port 44 is conveyed by the pair of registration rollers 13 to the secondary transfer roller 9. The sheet P1 and the sheet P2 conveyed by the pair of registration rollers 13 are subjected to common image formation, and accordingly the following description deals only with image formation with respect to the sheet P1, with no description repeated with respect to the sheet P2.

Used as the intermediate transfer belt 8 is a sheet made of a dielectric resin, typically a belt with no seams (seamless belt). The intermediate transfer belt 8 and the secondary transfer roller 9 are driven by a belt drive motor (not shown) to rotate at the same linear velocity as the photosensitive drums 1*a* to 1*d*. Downstream of the secondary transfer roller 9, a blade-form belt cleaner 19 is disposed which removes toner and the like that are left behind on the surface of the intermediate transfer belt 8.

Next, with reference back to FIG. 1, the image forming portions Pa to Pd will be described. Around and under the photosensitive drums 1*a* to 1*d*, which are rotatably disposed, there are disposed charging devices 2*a*, 2*b*, 2*c*, and 3*d* for electrostatically charging the photosensitive drums 1*a* to 1*d*, an exposure unit 5 for exposing the photosensitive drums 1*a* to 1*d* to light based on image data, developing devices 3*a*, 3*b*, 3*c* and 3*d* for developing electrostatic latent images formed on the photosensitive drums 1*a* to 1*d* with toner, and cleaning devices 7*a*, 7*b*, 7*c*, and 7*d* for collecting and removing developer (toner) that is left behind on the photosensitive drums 1*a* to 1*d* after the transfer of toner images.

In image forming operation, the charging devices 2*a* to 2*d* electrostatically charge the surfaces of the charging devices 2*a* to 2*d* uniformly, and then the exposure unit 5 irradiates them with light based on the image data, so that electrostatic latent images corresponding to the image data are formed on the photosensitive drums 1*a* to 1*d*. The developing devices 3*a* to 3*d* include developing rollers (developer carrying members) that are arranged so as to face the photosensitive drums 1*a* to 1*d*, and are loaded with predetermined amounts of two-component developer containing toner of different colors, namely magenta, cyan, yellow, and black respectively.

The toner in the developer is fed by the developing devices 3*a* to 3*d* onto the photosensitive drums 1*a* to 1*d* and electrostatically attaches to them, and thus toner images corresponding to the electrostatic latent images formed by exposure to light from the exposure unit 5 are formed.

The magenta, cyan, yellow, and black toner images on the photosensitive drums 1*a* to 1*d* are then primarily transferred to the intermediate transfer belt 8. These images of four colors are formed in a predetermined positional relationship with each other so as to form a predetermined full-color image. The primary transfer rollers 6*a* to 6*d* are rotated by a primary transfer drive motor (not shown) at the same linear velocity as the photosensitive drums 1*a* to 1*d* and the intermediate transfer belt 8. Then, in preparation for the subsequent formation of new electrostatic latent images, the toner left behind on the surfaces of the photosensitive drums 1*a* to 1*d* is removed by the cleaning devices 7*a* to 7*d*.

The intermediate transfer belt 8 is stretched around a driven roller 10 and a driving roller 11. As the above-mentioned belt drive motor drives the driving roller 11 to rotate, the intermediate transfer belt 8 starts to rotate counter-clockwise, with the result that a sheet P1 is conveyed from the pair of registration rollers 13 to, with predetermined timing, the nip (secondary transfer nip) between the secondary transfer roller 9, which is provided adjacent to the intermediate transfer belt 8, and the intermediate transfer belt 8. Thus, at the nip, a full-color toner image is transferred to the sheet P1. The sheet P1 having the toner image transferred to it is conveyed via the sheet conveyance passage 14 to the fixing device 15.

The sheet P1 conveyed to the fixing device 15 is heated and pressed as it passes through the nip (fixing nip) in a pair of fixing rollers 15*a*. Meanwhile the toner image is fixed to the surface of the sheet P1, and thus the predetermined full-color image is formed. The sheet P1 having the full-color image formed on it has its conveyance direction switched by the branch portion 17 which branches into a plurality of directions. In a case where an image is formed on only one side of the sheet P1, the sheet P1 is as it is discharged by the pair of discharge rollers 18 onto a discharge tray 20 provided on the top surface of the apparatus main body 40.

On the other hand, in a case where images are formed on both sides of the sheet P1, part of the sheet P1 having passed through the fixing device 15 and having the full-color image formed on it is momentarily jutted out of the apparatus main body 40 via the pair of discharge rollers 18. Then the pair of discharge rollers 18 is rotate reversely to feed the sheet P1 into the branch portion 17, which distributes it to the reversal conveyance passage 21. The sheet P1 having passed through the reversal conveyance passage 21 and reached the confluence with the sheet conveyance passage 14 is conveyed, with the image side reversed, once again to the secondary transfer roller 9. Then the next image formed on the intermediate transfer belt 8 is transferred by the secondary transfer roller 9 to the reverse side of the sheet P1 (its side on which no image has yet been formed). The sheet P1 is then conveyed to the fixing device 15, where the toner image is fixed, and is then discharged by the pair of discharge rollers 18 onto the discharge tray 20.

Figure 4:
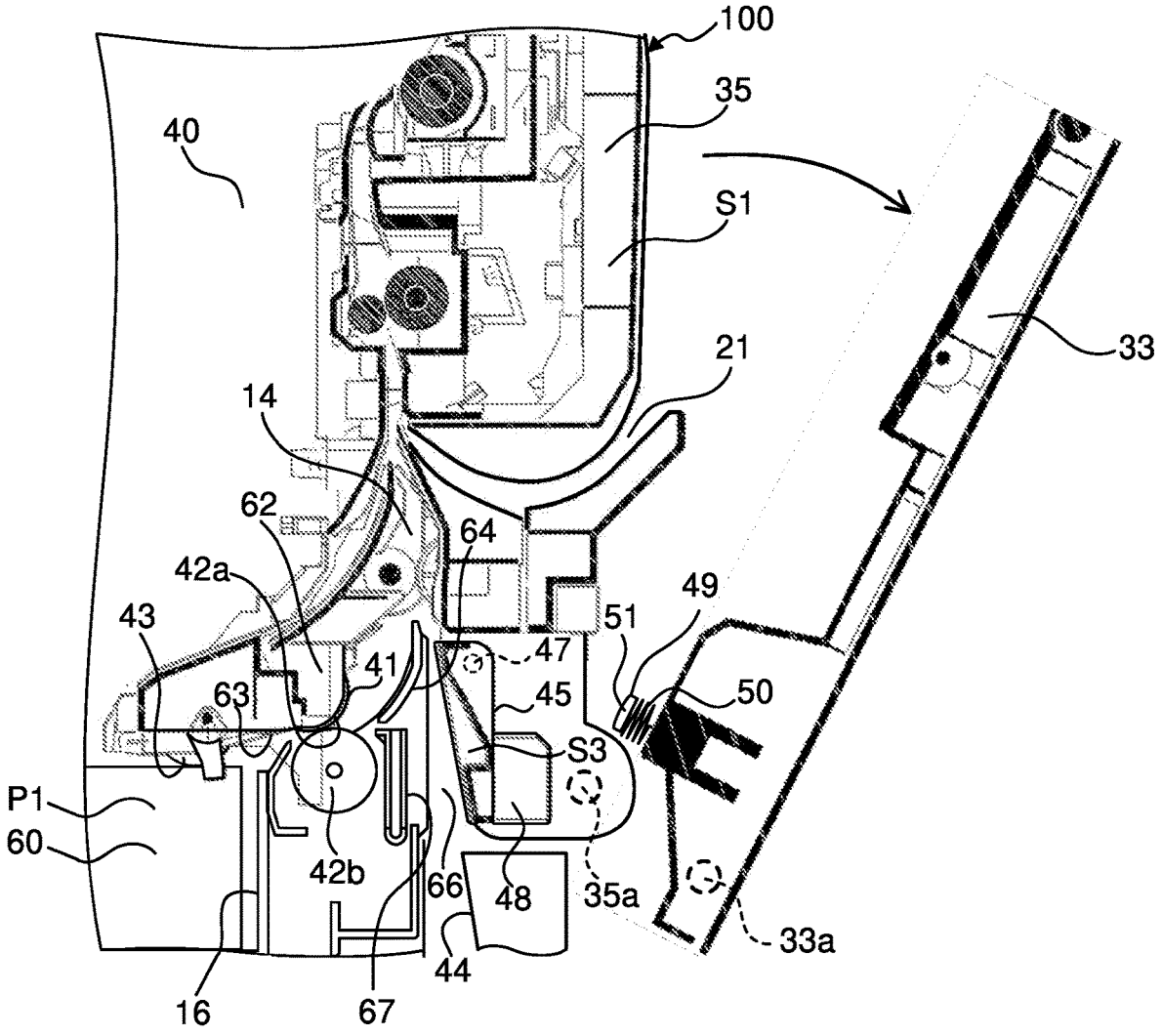
FIG. 4 is a sectional view of the image forming apparatus 100 in a state where a cover member 33 is open.
Figure 5:
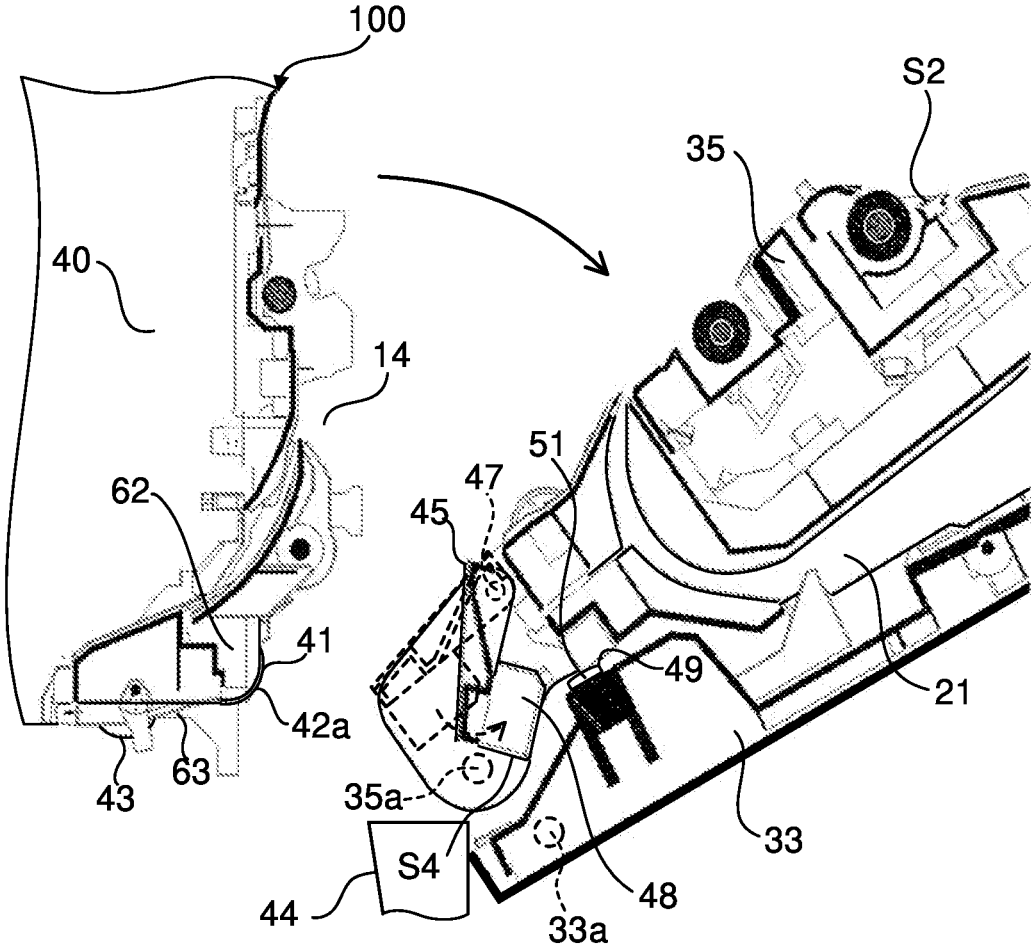
FIG. 5 is a sectional view of the image forming apparatus 100 in a state where, as a result of the cover member 33 along with a conveyance unit 35 being opened, the conveyance unit 35 is in an open position S2.

FIG. 4 is a sectional view of the image forming apparatus 100 in a state where the cover member 33 is open. FIG. 5 is a sectional view of the image forming apparatus 100 in a state where, as a result of the cover member 33 along with the conveyance unit 35 being opened, the conveyance unit 35 is in an open position S2. FIG. 5 shows a state with the sheet cassette 16 removed from the apparatus main body 40.

As shown in FIGS. 3 to 5, in a side part of the apparatus main body 40, a cover member 33 is provided. The cover member 33 forms a side surface of the image forming apparatus 100, and is pivotably supported at a pivot point 33*a* located in a lower part of the apparatus main body 40. Inside the cover member 33, the conveyance unit 35 is disposed. The conveyance unit 35 is supported so as to be pivotable between, with respect to the apparatus main body 40, a closed position S1 (see FIGS. 3 and 4) and an open position S2 (see FIG. 5) about a pivot shaft 35*a* located in a lower part of the apparatus main body 40.

Between the conveyance unit 35 and the cover member 33, an engagement mechanism (not shown) is provided. With the conveyance unit 35 and the cover member 33 engaged with each other by the engagement mechanism, the cover member 33 along with the conveyance unit 35 can be rotated. Here the cover member 33 rotates about the pivot point 33*a*, and the conveyance unit 35 rotates about the pivot shaft 35*a*.

As shown in FIG. 3, with the conveyance unit 35 in the closed position S1, part of the sheet conveyance passage 14 lies between the conveyance unit 35 and the apparatus main body 40. On the other hand, with the conveyance unit 35 in the closed position S1 and the cover member 33 closed, the reversal conveyance passage 21 lies between the conveyance unit 35 and the cover member 33. The reversal conveyance passage 21 extends from the branch portion 17 downward along a side surface of the image forming apparatus 100, and bends substantially in a C shape to meet the sheet conveyance passage 14 at a position upstream of the secondary transfer roller 9 and the pair of registration rollers 13. The inner surface of the cover member 33 forms a part, at one side, of the conveyance surface of the reversal conveyance passage 21, and the outer surface of the conveyance unit 35 forms a part, at the other side, of the conveyance surface of the reversal conveyance passage 21.

Pivoting only the cover member 33 about the pivot point 33*a* in the opening direction with respect to the apparatus main body 40 (the direction in which the cover member 33 moves away from the apparatus main body 40) while keeping the conveyance unit 35 in the closed position S1 permits the reversal conveyance passage 21 to be exposed over a large area (see FIG. 4). Pivoting the cover member 33 along with the conveyance unit 35 in the opening direction permits the conveyance unit 35 to move away from the apparatus main body 40 to the open position S2, and permits the sheet conveyance passage 14 to be exposed over a large area (see FIG. 5). This makes it possible to access the feed unit 41 from the cover member 33 side.

In a lower part of the conveyance unit 35, a swing guide 45 is provided (see FIG. 3). The swing guide 45 is provided adjacent to the introduction port 44 in the sheet conveyance direction (here, the up-down direction), and forms part of the wall surface of the sheet conveyance passage 14. The swing guide 45 is supported so as to be pivotable about a pivot point 47. With the cover member 33 closed, the swing guide 45 is located in a first position S3 where it faces the feed unit 41 in the mounting direction. The swing guide 45 forms part of the inner wall of the sheet conveyance passage 14 and guides downward along the sheet conveyance passage 14 a sheet P2 introduced through the introduction port 44.

In the sheet conveyance passage 14, between the swing guide 45 and the opposite face 67, a bypass path 66 is formed. The bypass path 66 extends upward from the introduction port 44. The sheet P2 introduced through the introduction port 44 passes through the bypass path 66 to be guided to the sheet conveyance passage 14.

The swing guide 45 is provided with a weight portion 48 at a position below the pivot point 47 so that its center of gravity is lopsided downward. Owing to this weight portion 48, as the conveyance unit 35 rotates about the pivot shaft 35*a*, the swing guide 45 swings about the pivot point 47 under its own weight. That is, owing to the swing guide 45 having its center of gravity lopsided by the weight portion 48, as the cover member 33 along with the conveyance unit 35 is operated in the opening direction, the swing guide 45 rotates about the pivot point 47 counter-clockwise in the illustration, that is, downward, to move to a second position S4, which is located away from the feed unit 41. On the other hand, operating the cover member 33 in the open state along with the conveyance unit 35 located in the first position S3 in the closing direction (the direction in which they move toward the apparatus main body 40), the swing guide 45 pivots about the pivot point 47 under its own weight, and moves from the second position S4 to the first position S3 so as to move toward the feed unit 41.

In FIG. 5, broken lines indicate the imaginary position of the swing guide 45 that it will assume if the swing guide 45 does not rotate when the cover member 33 is opened along with the conveyance unit 35. As shown there, rotating movement of the swing guide 45 from the position indicated by the broken lines to the position indicated by the solid lines (second position S4) results in an increased distance between the feed roller 42*a* in the feed unit 41 and the swing guide 45. That is, as compared with the distance between the feed unit 41 and the swing guide 45 that would be observed if the swing guide 45 did not rotate, the distance between the swing guide 45 in the second position S4 and the feed unit 41 is larger. Accordingly, the width of the bypass path 66 is larger (not illustrated).

Between the cover member 33 and the swing guide 45, an urging member 49 is provided. The urging member 49 can be configured to be composed of a coil spring 50 formed in a spiral shape and a contact portion 51 provided at a tip end of the coil spring 50. The contact portion 51 can be a member formed of a common resin material such as silicone resin or PP resin.

Operating the cover member 33 along with the conveyance unit 35 in the closing direction and closing the cover member 33 with respect to the apparatus main body 40 results in the weight portion 48 of the swing guide 45 making contact with the contact portion 51. Thus, by the resilient force of the coil spring 50, the swing guide 45 is urged toward the feed unit 41 and is positioned in the first position S3 facing the feed unit 41. Operating the cover member 33 along with the conveyance unit 35 in the opening direction so that the conveyance unit 35 is in the open position S2 results in the contact portion 51 being located away from the swing guide 45 (see FIG. 5). Thus the swing guide 45, without being urged by the urging member 49, rotates to the first position S3 under its own weight.

As described above, with the cover member 33 closed, the swing guide 45 is in the first position S3; when along with the conveyance unit 35 the cover member 33 is opened, the swing guide 45 moves to the second position S4 under its own weight. This results in, since the second position S4 is located away from the feed unit 41, a larger distance between the feed unit 41 and the swing guide 45, and contributes to improved workability around the feed unit 41 during, for example, replacement work for the feed roller 42*a*. Moreover, the swinging operation of the swing guide 45 accompanying the operation of the cover member 33 does not require a complex structure like a link mechanism and is achieved with a simple structure relying on its own weight. It is thus possible to provide an image forming apparatus that can suppress, with a simple structure, degradation of workability around the feed unit 41.

Moreover, as described above, closing the cover member 33 causes the contact portion 51 of the urging member 49 to make contact with the weight portion 48 of the swing guide 45, and the urging member 49 urges the swing guide 45 toward the first position S3. Here, when the cover member 33 is closed, the swing guide 45 is pressed against the positioning portion (not illustrated) in the apparatus main body 40 and moves to the first position S3 properly. On the other hand, opening the cover member 33 along with the conveyance unit 35 causes the urging member 49 to move away from the swing guide 45 and cease to press the swing guide 45, and the swing guide 45 pivots under its own weight. Thus, with the above-described structure provided with the urging member 49, when the cover member 33 is opened, the swing guide 45 rotates to the second position S4 under its own weight, and when the cover member 33 is closed the swing guide 45 is positioned in the first position S3. It is thus possible, with a simple structure, to achieve more proper positioning of the swing guide 45 in rotation.

The present disclosure can be implemented in any manner other than as in the embodiment specifically described above, and allows for many modifications without departure from the spirit of the present disclosure. For example, while in the embodiment described above the swing guide 45 and the introduction port 44 are configured as separate members and the swing guide 45 is disposed so as to be adjacent to the introduction port 44, the swing guide 45 may be configured to constitute part of the introduction port 44. In that case, a lower end part of the swing guide 45 is located in a lowermost part of the apparatus main body 40 to constitute part of the opening rim of the introduction port 44. With this design, as the cover member 33 rotates, the part of the sheet conveyance passage 14 that faces the feed unit 41 is located away from the feed unit 41 over a comparatively large area. This gives a larger working space around the feed unit 41, and helps appropriately suppress degradation in workability.

For another example, while the embodiment described above deals with an urging member 49 configured to be composed of a coil spring 50 and the contact portion 51, the contact portion 51 may be omitted, in which case the coil spring 50 can be configured to make direct contact with the swing guide 45. This design helps give the urging member 49 a simple structure, and helps suppress an increase in manufacturing cost.

The present disclosure finds applications in image forming apparatuses such as copiers, printers, and facsimile machines as well as multifunction peripherals having their functions integrated together. Based on the present disclosure, it is possible to secure, when opening a cover member, a larger distance between a feed unit and a swing guide, and it is thus possible to secure working space around the feed unit. It is thus possible to provide an image forming apparatus that can suppress, with a simple structure, degradation in workability around a feed unit.

What is claimed is:

1. An image forming apparatus comprising:

an apparatus main body having an image forming portion therein;

a sheet conveyance passage formed inside the apparatus main body and extending in an up-down direction along a side surface of the apparatus main body;

a cover member which is supported so as to be rotatable about a lower end part thereof with respect to the side surface of the apparatus main body and is openable and closable;

a conveyance unit provided inside the cover member in the apparatus main body and supported so as to be pivotable between an open position, where the sheet conveyance passage is opened, and a closed position, where the sheet conveyance passage is closed;

a sheet tray on which a sheet is stacked; and a first sheet feeding portion which is provided in a lower part of the apparatus main body and to which the sheet tray is detachably mounted, wherein the first sheet feeding portion includes a feed unit configured to feed the sheet stacked on the sheet tray, the conveyance unit includes a swing guide swingably supported on the conveyance unit, the swing guide has:

a pivot point about which the swing guide swings; and a weight portion located opposite from the pivot point across a middle of the swing guide in an up-down direction, the swing guide having a center of gravity thereof lopsided toward the weight portion, when the conveyance unit is in the closed position, the swing guide is located in a first position where the swing guide faces the feed unit and constitutes part of the sheet conveyance passage and, when the conveyance unit is in the open position, the swing guide is located in a second position where the swing guide is located away from the feed unit, and when the conveyance unit pivots between the closed position and the open position, as the conveyance unit pivots, the swing guide swings between the first position and the second position about the pivot point under an own weight of the swing guide acting on the center of gravity.

2. The image forming apparatus according to claim 1, further comprising:

an urging member provided on the cover member and urging the swing guide, and when the conveyance unit is in the closed position, the urging member makes contact with the swing guide to urge the swing guide toward the first position and, when the conveyance unit is in the open position, the urging member is located away from the swing guide.

3. The image forming apparatus according to claim 1, further comprising:

a sheet reversing portion connected to a downstream part of the image forming portion, the sheet reversing portion configured to reverse a conveyance direction of the sheet having an image formed thereon in the image forming portion; and a reversal conveyance passage which is formed between the conveyance unit and the cover member in the apparatus main body, the reversal conveyance passage configured to receive the sheet reversed in the sheet reversing portion to feed the sheet to the sheet conveyance passage.

4. The image forming apparatus according to claim 1, wherein the feed unit includes:

a pickup roller making contact with a top surface of a sheet stacked on the sheet tray to feed the sheet;

a feed roller feeding downstream the sheet fed from the pickup roller; and a feed holder supporting the pickup roller and the feed roller, the feed holder being mountable and dismountable with respect to the feed unit at a cover member side of the feed holder, wherein with the swing guide disposed in the second position, the feed holder can be accessed from the cover member side.

5. The image forming apparatus according to claim 4, further comprising:

a second sheet feeding portion located below the first sheet feeding portion, wherein the first sheet feeding portion includes:

an upper feed guide on which the feed holder is supported; and a lower feed guide located under the upper feed guide, the lower feed guide has an opposite wall which, in a lower end part of the conveyance unit, faces the swing guide, and the swing guide, in the closed position, forms a bypass path which guides the sheet fed from the second sheet feeding portion to the sheet conveyance path between the swing guide and the opposite wall.

* * * * *